US008206086B1

(12) United States Patent
Johnson et al.

(10) Patent No.: US 8,206,086 B1
(45) Date of Patent: Jun. 26, 2012

(54) TURBOFAN HYBRID METALLIC AND PLASTIC INLET CASE

(75) Inventors: Paul D Johnson, Palm Beach Gardens, FL (US); Ryan C McMahon, North Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1025 days.

(21) Appl. No.: 12/107,659

(22) Filed: Apr. 22, 2008

(51) Int. Cl.
*F04D 29/54* (2006.01)

(52) U.S. Cl. ..... 415/137; 415/189; 415/191; 415/200; 415/208.2; 415/210.1

(58) Field of Classification Search ..... 415/135, 415/183, 189, 191, 200, 202, 208.1, 208.2, 415/209.2, 209.3, 210.1
See application file for complete search history.

(56) References Cited

U.S. PATENT DOCUMENTS 2,995,294 A * 8/1961 Warnken ..... 415/209.2
3,442,442 A * 5/1969 Seiwert ..... 415/200
3,588,267 A * 6/1971 Wilkinson ..... 415/135
4,140,433 A * 2/1979 Eckel ..... 415/209.1
4,786,347 A * 11/1988 Angus ..... 416/198 A
4,832,568 A * 5/1989 Roth et al. ..... 415/189
5,074,752 A * 12/1991 Murphy et al. ..... 415/209.4
5,494,404 A * 2/1996 Furseth et al. ..... 415/209.3

* cited by examiner

*Primary Examiner* — Igor Kershteyn
(74) *Attorney, Agent, or Firm* — John Ryznic

(57) ABSTRACT

An inlet case for a small gas turbine engine, where the inlet case is formed as a hybrid piece with a metallic inner shroud cylinder and plastic guide vanes and plastic outer shroud molded around the metallic inner shroud cylinder. The metallic inner shroud cylinder carries an electric generator and provides for a good convective heat transfer surface to carry heat away from the electric generator and into the inlet air flow entering the engine. The plastic guide vanes and outer shroud allow for a light weight inlet case assembly that is also much easier to form the airfoil shapes than a machined metallic inlet case. The plastic guide vanes and outer shroud are injection molded around the metallic inner shroud cylinder to produce a rigid single inlet case. The metallic cylinder includes axial extending slots that receive the lower ends of the guide vanes during the injection molding process.

18 Claims, 3 Drawing Sheets

TURBOFAN HYBRID METALLIC AND PLASTIC INLET CASE

FEDERAL RESEARCH STATEMENT

The US Government has a paid-up license in this invention and the right in limited circumstances to require the patent owner to license others on reasonable terms as provided for by the terms of Contract No. W31P4Q-05-C-R003 awarded by the United States Army.

CROSS-REFERENCE TO RELATED APPLICATIONS

None.

BACKGROUND OF THE INVENTION

1. Field of the Invention

The present invention relates generally to a small turbofan engine, and more specifically to an inlet case for the turbofan engine which houses an electric generator.

2. Description of the Related Art Including Information Disclosed Under 37 CFR 1.97 and 1.98

Small gas turbine engines—under around 300 pounds of thrust—are ideal for use with small unmanned aero vehicles (UAV) because of their high efficiency and light weight compared to other types of power plants such as an internal combustion engine. A small turbofan engine would have an inlet case with a row of guide vanes to direct the inlet air flow into the fan and compressor of the engine. Typical of these small turbofan engines is the use of an electric generator carried within the inlet case, since this location is ideal in that the nose cone can store the generator and the nose cone is usually empty space.

In the prior art, the inlet case is made of either a metallic material such as aluminum, steel and titanium, or a plastic material. Both of these variations of the inlet case have major drawbacks. The electric generator creates allot of heat from operation. A metallic inlet case will be a good conductor of heat (compared to the all plastic inlet case) to transfer the heat generated by the generator. However, the metallic inlet case would be relatively heavy and require complex machining (compared to the plastic inlet case) to form the inlet guide vanes. The cost of these metallic inlet cases would be very high compared to a plastic injection molded inlet case due mainly from the machining of the airfoils. In the plastic inlet case, the plastic material does not conduct heat very well. The plastic inlet case would be much cheaper to produce compared to the metallic inlet case and relatively lighter in weight. However, the plastic inlet case would not conduct enough of the heat generated by the electric generator to be of much use.

BRIEF SUMMARY OF THE INVENTION

It is an object of the present invention to produce an inlet case for a small turbofan engine that will be a good conductor of heat like that of an all-metallic inlet case, yet be cheap to produce like that of the plastic inlet case.

It is also an object of the present invention to produce an inlet case for a small turbofan engine that will be light weight in order to keep the overall weight of the engine down.

The present invention is a hybrid inlet case for the small turbofan engine in which the inlet case includes an metallic inner cylinder portion that forms the housing for the electric generator and forms the inner flow path for the air flow through the inlet case, and the guide vanes and the outer shroud are formed of plastic in an injection molding process to provide the light weight and the accurate shaped guide vane airfoils without machining. The metallic inner cylinder or shroud includes dovetail slots extending along the outer surface of the cylinder. The guide vanes are formed within the slots to secure the guide vanes and the outer shroud to the metallic inner cylinder and form the rigid hybrid inlet case. The metallic inner cylinder can be easily formed by a protrusion or a machining process because of the simplified geometry.

The present invention is also a small gas turbine engine having a hybrid inlet case formed from a metallic inner shroud cylinder with a plurality of plastic guide vanes and a plastic outer shroud injection molded around the metallic cylinder. The metallic inner shroud cylinder operatively secures an electric generator to produce electrical power during engine operation. The metallic inner shroud cylinder therefore functions as a good convective surface to transfer the heat generated from the generator away from the inner shroud and into the inlet air flowing into the guide vanes.

The present invention is also a process for producing a hybrid inlet case for a small gas turbine engine, where the hybrid inlet case is formed from a metallic inner shroud cylinder that has a plurality of axial extending slots formed along the outer surface to provide structure to secure a plurality of guide vanes to the metallic cylinder. Plastic guide vanes and a plastic outer shroud is injection molded around the metallic inner shroud cylinder to produce a rigid single piece inlet case made with a metallic inner shroud and plastic vanes and outer shroud that is both lightweight and transfer heat away from the generator and into the inlet air flow.

DETAILED DESCRIPTION OF THE INVENTION

Figure 1:
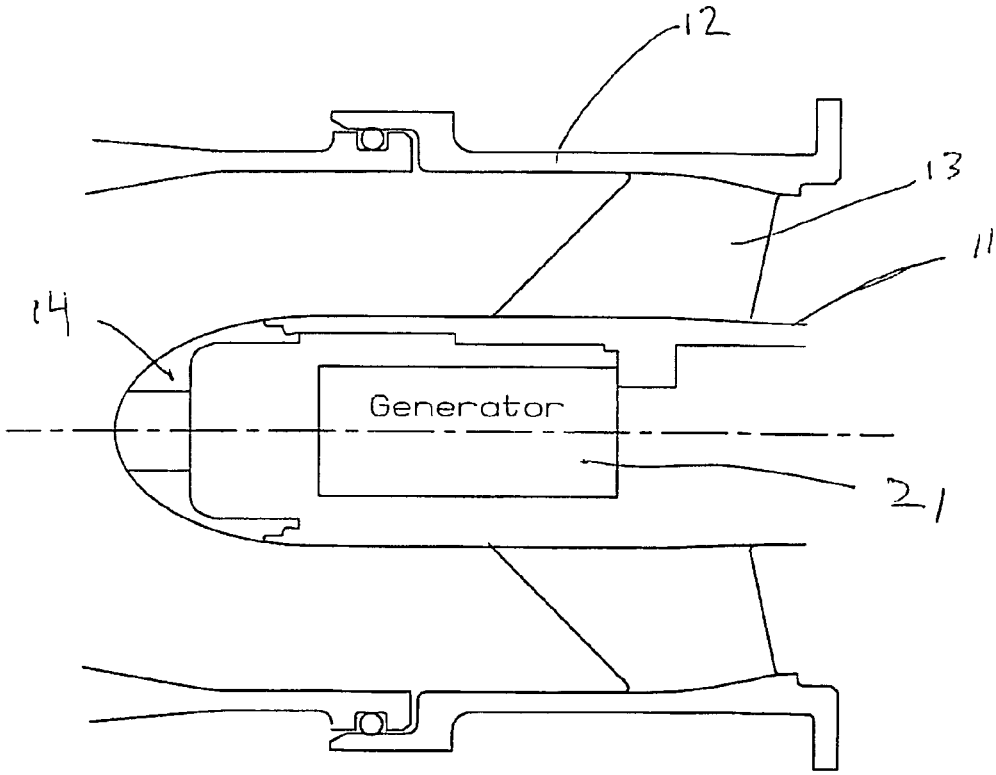
FIG. 1 shows a cross section view of an inlet section of the small turbofan gas turbine engine with the inlet case of the present invention.

The present invention is an inlet case for use on a small twin spool gas turbine engine. The size of the engine is under around 300 pounds thrust. The inlet case is shown in FIG. 1 and includes an inner shroud 11 formed by a cylindrical member and an outer shroud 12. The metallic cylinder 11 forms the inner shroud of the inlet case and can be made from titanium, aluminum or steel. A number of struts or guide vanes 13 extend between the inner shroud and the outer shroud. A nose cone 14 closes off the front of the inner shroud cylindrical member 11. An electric generator assembly 21 is operatively mounted within the inner shroud cylinder 11. The hybrid inlet case is made from a metallic inner shroud 11 and plastic guide vanes 13 and outer shroud 12 to form a lightweight but rigid inlet case.

Figure 2:
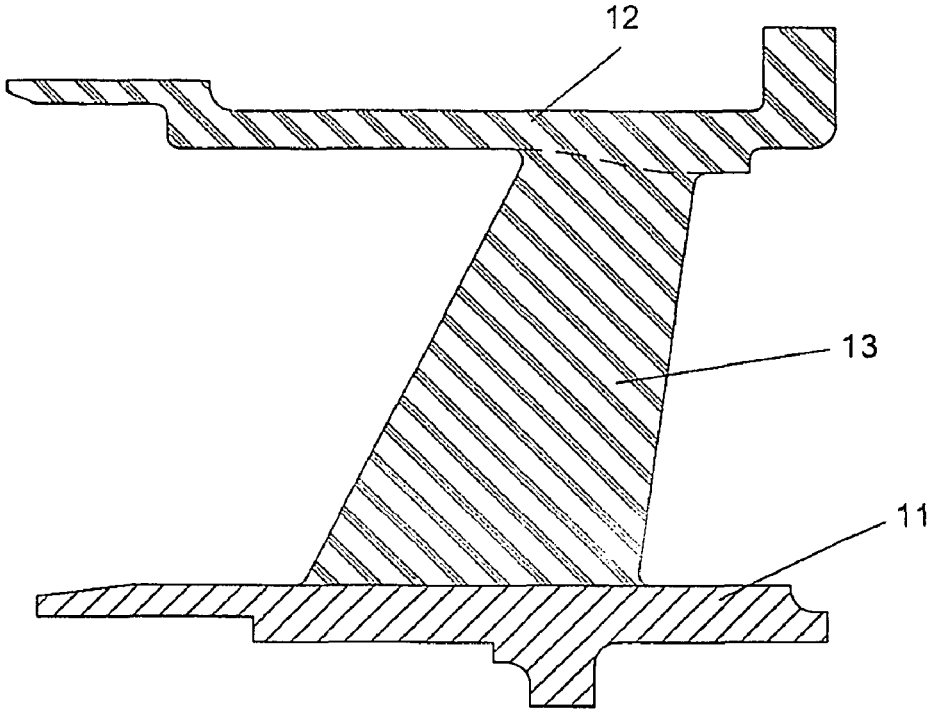
FIG. 2 shows a cross section side view of the inlet case of the present invention.

FIG. 2 shows a cross section side view of the inlet case and includes the metallic inner shroud cylinder 11, plastic struts or guide vanes 13 extending outward from the inner shroud 11, and a plastic outer shroud 12 surrounding the struts or guide vanes 13. An inlet air flow path is formed between the inner shroud 11 and the outer shroud 12 for the air entering the engine.

Figure 3:
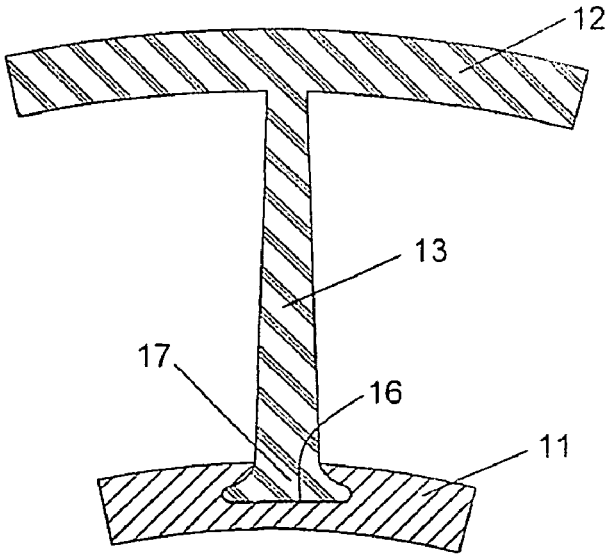
FIG. 3 shows a cross section front view of the inlet case of the present invention.
Figure 4:
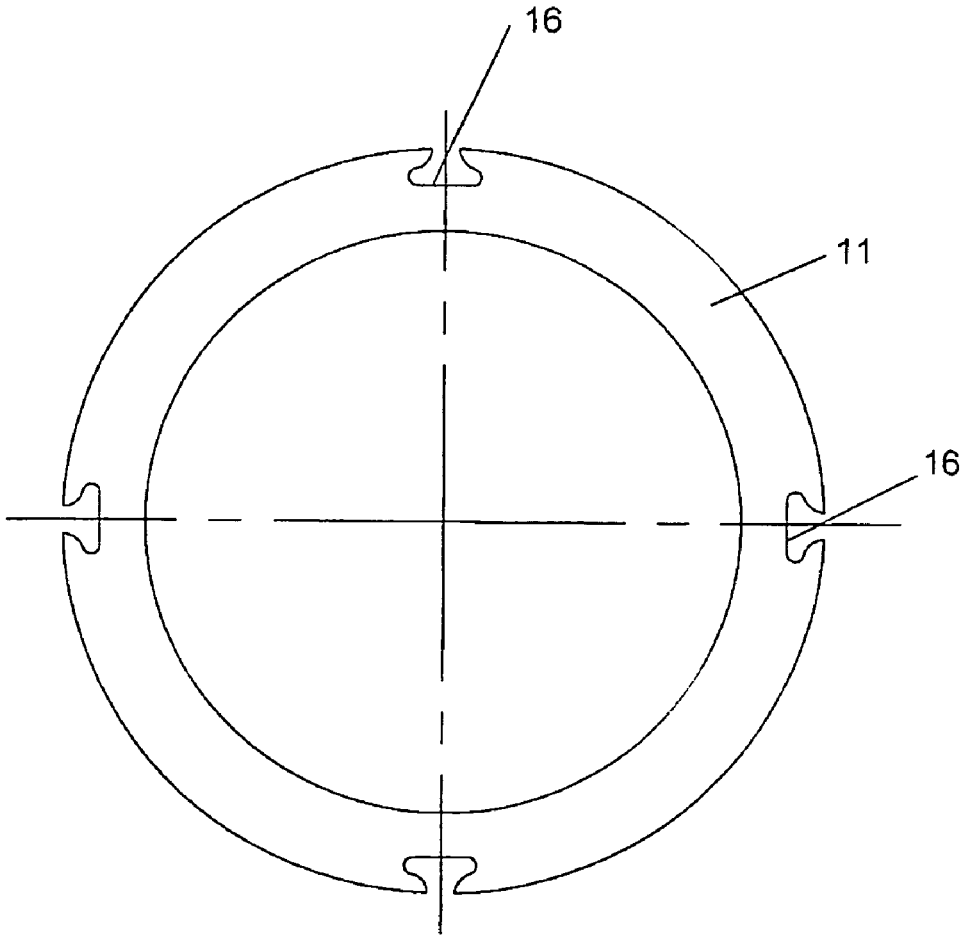
FIG. 4 shows a front view along the axis of the metallic inner shroud of the inlet case of the present invention.

FIG. 3 shows a front view of the hybrid inlet case with a slot 16 formed in the outer surface of the inner shroud 11 cylinder. The guide vane 13 includes a lower end 17 that fits within the slot 16 to secure the plastic portion (12,13) of the inlet case to the metallic cylindrical portion 11. FIG. 4 shows a front view of the metallic cylindrical portion 11 in which four dovetail shaped slots 16 are evenly spaced apart and around the outer surface of the inner shroud cylinder 11. This arrangement is one reason why the hybrid inlet case of the present invention is very cheap to produce. The slots 16 can easily and cheaply be machined or formed in the metallic cylinder 11, especially if the inner shroud cylinder 11 is formed from aluminum.

The hybrid inlet case is formed by injection molding of the vanes 13 and the outer shroud 12 around the metallic inner shroud cylinder 11. The aluminum inner shroud cylinder 11 with the slots formed therein is placed within a die used for the plastic injection molding process. The vanes 13 and the outer shroud 12 are then formed by the plastic injection molding process in which a plastic molten material is injected into the die to form the vanes and outer shroud 12. The lower ends 17 of the guide vanes 13 will take the shape of the slots 16 in the cylinder 11 due to the injection molding process.

With the hybrid inlet case of the present invention, the metallic inner shroud cylinder provides a good conductor of heat to draw the heat generated by the electric generator and away from the inner shroud. The inlet air flow entering the engine passes over the metallic inner shroud and draws heat away from the generator, keeping the inner shroud cylinder cool. With the plastic injection molded guide vanes, no machining of the guide vanes is required and therefore the total cost of production of the part remains low. An all metal inlet case of the prior art would cost around $2,000 to produce for each inlet case. The hybrid inlet case of the present invention costs less than $50 to produce each one, a significant cost savings. The hybrid inlet case of the present invention is also light in weight compared to the all metallic inlet case. Thus, additional savings is obtained since the engine is lighter overall and therefore more efficient as a power plant for an UAV.

We claim the following:

1. A hybrid inlet case for use on a small gas turbine engine, the hybrid inlet case comprising:

a metallic cylinder forming an inner shroud of the inlet case;

a plurality of guide vane connecting slots formed along the outer surface of the metallic cylinder;

a guide vane assembly having an annular arrangement of guide vanes extending from an outer shroud;

the guide vanes and the outer shroud formed as an injection-moldable single piece and from a plastic material; and, inner ends of the annular arrangement of guide vanes being secured to guide vane connecting slots.

2. The hybrid inlet case of claim 1, and further comprising:

the guide vanes and outer shroud are formed from a plastic injection molding process.

3. The hybrid inlet case of claim 1, and further comprising:

the metallic inner shroud cylinder includes a space to operatively secure an electric generator.

4. The hybrid inlet case of claim 1, and further comprising:

a nose cone to enclose a forward opening of the metallic inner shroud cylinder.

5. The hybrid inlet case of claim 1, and further comprising:

the guide vane and the outer shroud are formed from a relatively high temperature resistant plastic material that has a strength greater than that of aluminum.

6. The hybrid inlet case of claim 1, and further comprising:

the hybrid inlet case includes four guide vanes secured to four slots in the metallic inner shroud cylinder, the four guide vanes being substantially equally spaced around the metallic inner shroud cylinder.

7. The hybrid inlet case of claim 1, and further comprising:

the small gas turbine engine is less than 300 pounds of thrust.

8. A hybrid inlet case for use on a small gas turbine engine, the hybrid inlet case comprising:

a metallic cylinder forming an inner shroud of the inlet case;

a guide vane connecting slot formed along the outer surface of the metallic cylinder;

a plastic guide vane extending from the inner shroud, the plastic guide vane having a lower end secured within the slot formed on the metallic cylinder;

a plastic outer shroud surrounding the inner shroud and the guide vane to form a flow path for air entering the engine; and, at least one guide vane having a passage extending through the guide vane to carry an electrical cord from the inner shroud to the outer shroud of the inlet case.

9. A small gas turbine engine comprising:

a compressor with a row of compressor blades;

an inlet case having a row of inlet guide vanes extending between an inner shroud and an outer shroud of the inlet case, the guide vanes being located upstream of the row of compressor blades;

an electric generator operatively mounted within the inlet case;

the inlet case being formed from a metallic inner shroud cylinder and plastic guide vanes and plastic outer shroud to produce a light weight inlet case that provides for a good conductor of heat away from the electric generator and into the inlet air flow passing through the inlet case; and, the plastic guide vanes and the plastic outer shroud being formed as a single piece from an injection-moldable plastic material.

10. The small gas turbine engine of claim 9, and further comprising:

a nose cone to cover the open end of the metallic inner shroud cylinder.

11. The small gas turbine engine of claim 9, and further comprising:

the guide vanes are secured within slots extending along the outer surface of the metallic inner shroud cylinder.

12. The small gas turbine engine of claim 9, and further comprising:

the metallic inner shroud cylinder is formed substantially from aluminum.

13. The small gas turbine engine of claim 9, and further comprising:

the plastic guide vanes and plastic outer shroud is formed from a relatively high temperature resistant plastic material that has a strength greater than that of aluminum.

14. The small gas turbine engine of claim 9, and further comprising:

The metallic inner shroud cylinder operates as a convective heat transfer surface when the inlet air flows through the guide vanes to draw heat away from the electric generator during engine operation.

15. A small gas turbine engine comprising:

a compressor with a row of compressor blades;

an inlet case having a row of inlet guide vanes extending between an inner shroud and an outer shroud of the inlet case, the guide vanes being located upstream of the row of compressor blades;

an electric generator operatively mounted within the inlet case;

the inlet case being formed from a metallic inner shroud cylinder and plastic guide vanes and plastic outer shroud to produce a light weight inlet case that provides for a good conductor of heat away from the electric generator and into the inlet air flow passing through the inlet case; and, at least one of the guide vanes includes a passage to carry an electrical wire from the electric generator to outside the outer shroud.

16. A process for producing an inlet case for a small gas turbine engine, the process comprising the steps of:

forming a cylindrical inner shroud cylinder from a metallic material;

forming a plurality of guide vane securing slots along the outer surface of the metallic inner shroud cylinder; and, molding a plurality of plastic guide vanes and a plastic outer shroud around the metallic inner shroud cylinder.

17. The process for producing an inlet case of claim 16, and further comprising the step of:

molding the plastic guide vanes and the plastic outer shroud as a single piece that is secured to the slots in the metallic inner shroud cylinder.

18. The process for producing an inlet case of claim 16, and further comprising the step of:

forming the metallic inner shroud cylinder of such thickness that the metallic inner shroud cylinder operates as a good convective heat transfer surface to transfer heat from inside the metallic cylinder to inlet air flowing through the guide vanes.

* * * * *